US006843476B2

(12) United States Patent
Schuller et al.

(10) Patent No.: US 6,843,476 B2
(45) Date of Patent: Jan. 18, 2005

(54) PRINT MEDIA STACK CLAMP

(75) Inventors: Peter D. Schuller, Coon Rapids, MN (US); Thomas G. Lindblom, Claremont, MN (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 36 days.

(21) Appl. No.: 10/396,277

(22) Filed: Mar. 24, 2003

(65) Prior Publication Data

US 2004/0188925 A1 Sep. 30, 2004

(51) Int. Cl.[7] ..... B65H 31/00
(52) U.S. Cl. ..... 271/207; 271/3.04
(58) Field of Search ..... 271/207, 3.04, 271/220

(56) References Cited

U.S. PATENT DOCUMENTS 5,026,034 A * 6/1991 Russel et al. ..... 271/220
6,209,865 B1 * 4/2001 Regimbal et al. ..... 271/220
6,311,971 B1 11/2001 Greer et al.
6,474,640 B1 * 11/2002 Bunch, III ..... 271/286

* cited by examiner

*Primary Examiner*—Donald P. Walsh
*Assistant Examiner*—Kenneth W Bower

(57) ABSTRACT

A print media stack clamp and method for processing print media in an output receptacle. In one embodiment, a print media output device includes an output receptacle and a surface extending over and facing the receptacle. One or both of the receptacle and the surface are movable relative to one another such that print media output to the receptacle can be alternately clamped between the surface and the receptacle and released. In another embodiment, a method for processing print media in an output receptacle includes outputting a first document to the receptacle, moving the first document toward one side of the receptacle, clamping the first document in the receptacle, outputting a second document to the receptacle on top of the first document while the first document is clamped, releasing the first document, and moving the second document toward the one side of the receptacle.

13 Claims, 9 Drawing Sheets

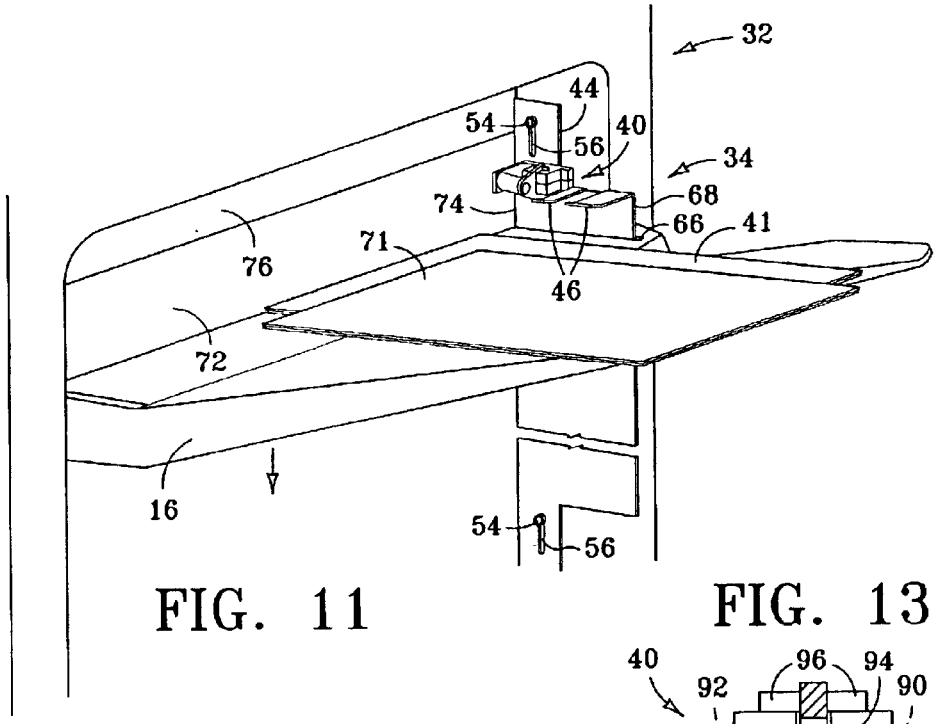
FIG. 11
FIG. 13
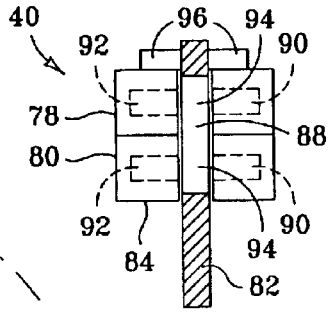
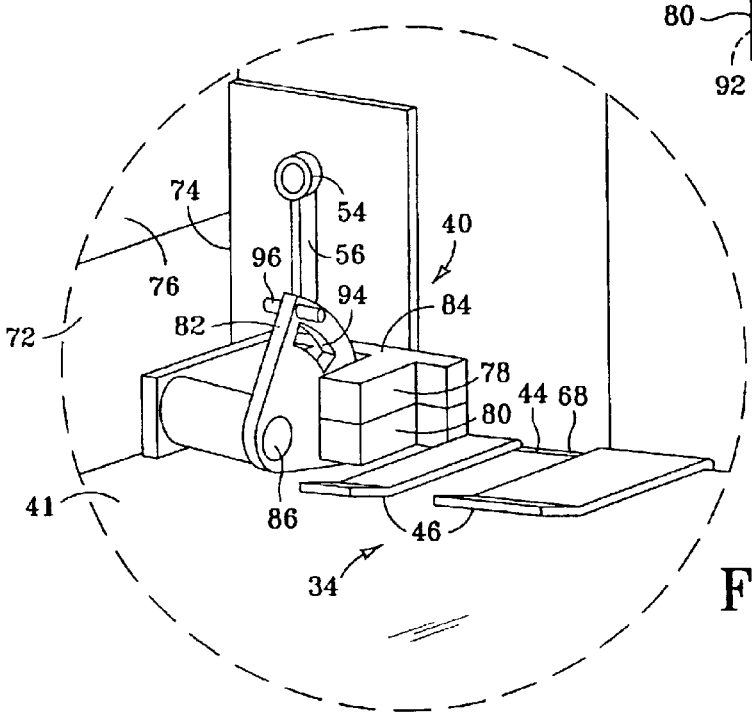
FIG. 12

PRINT MEDIA STACK CLAMP

FIELD OF THE INVENTION

The invention is directed to a print media stack clamp and method for processing print media in an output receptacle.

BACKGROUND

Printed documents output by printers and post print finishing devices on to a stack of documents can dislodge the top documents in the stack as they "bulldoze" into the stack. Where the documents in the stack are aligned with one another, it is often important to maintain that alignment as new documents are added to the stack. The present invention was developed in an effort to help minimize "bulldozing" as new documents are output to the stack.

DESCRIPTION OF THE DRAWINGS

FIGS. 5–11 are perspective views showing the structure and sequence of operation of a stack clamp according to one embodiment of the invention.

FIG. 12 is a detail perspective view of the stack position sensor of the stack clamp of FIGS. 5–10 in the position shown in FIG. 8.

FIG. 13 is a detail elevation section view of the stack position sensor shown in FIG. 12.

DETAILED DESCRIPTION

Figure 1:
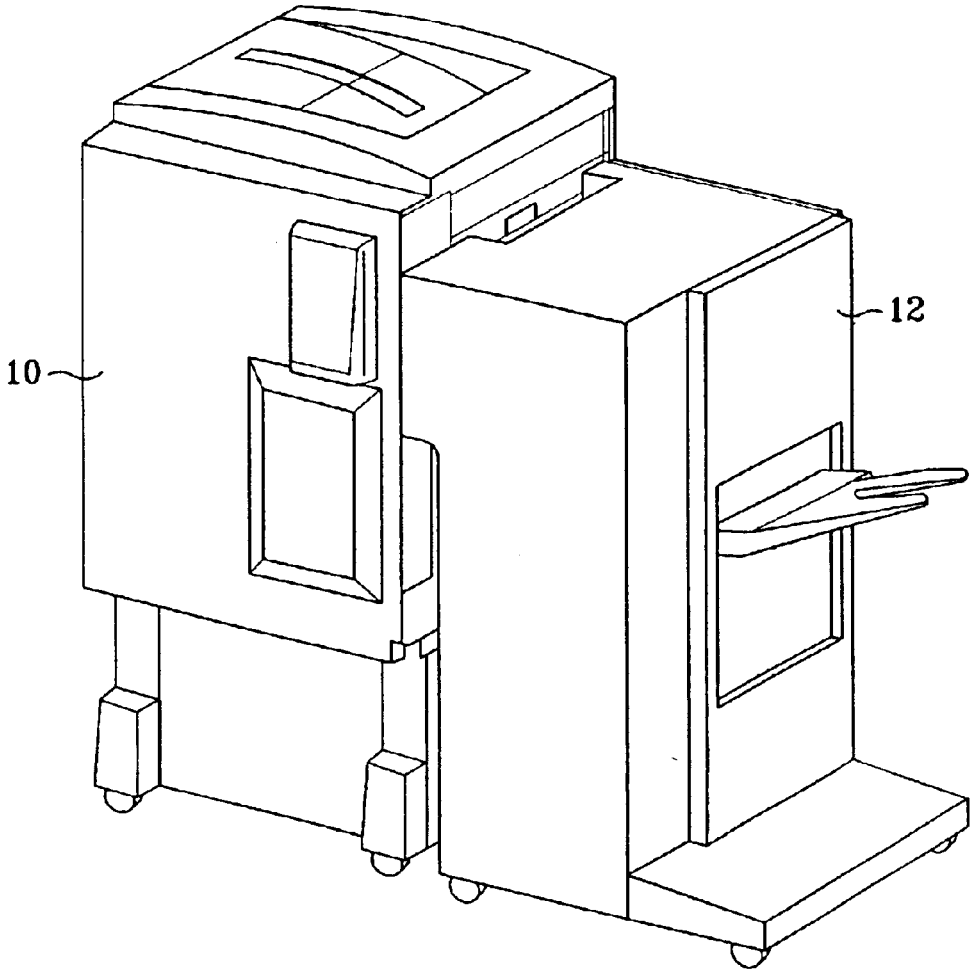
FIG. 1 is a perspective side view illustrating a printer with an attached post print finishing device.

FIG. 1 illustrates a printer 10 with an attached post print finishing device 12.

Figure 2:
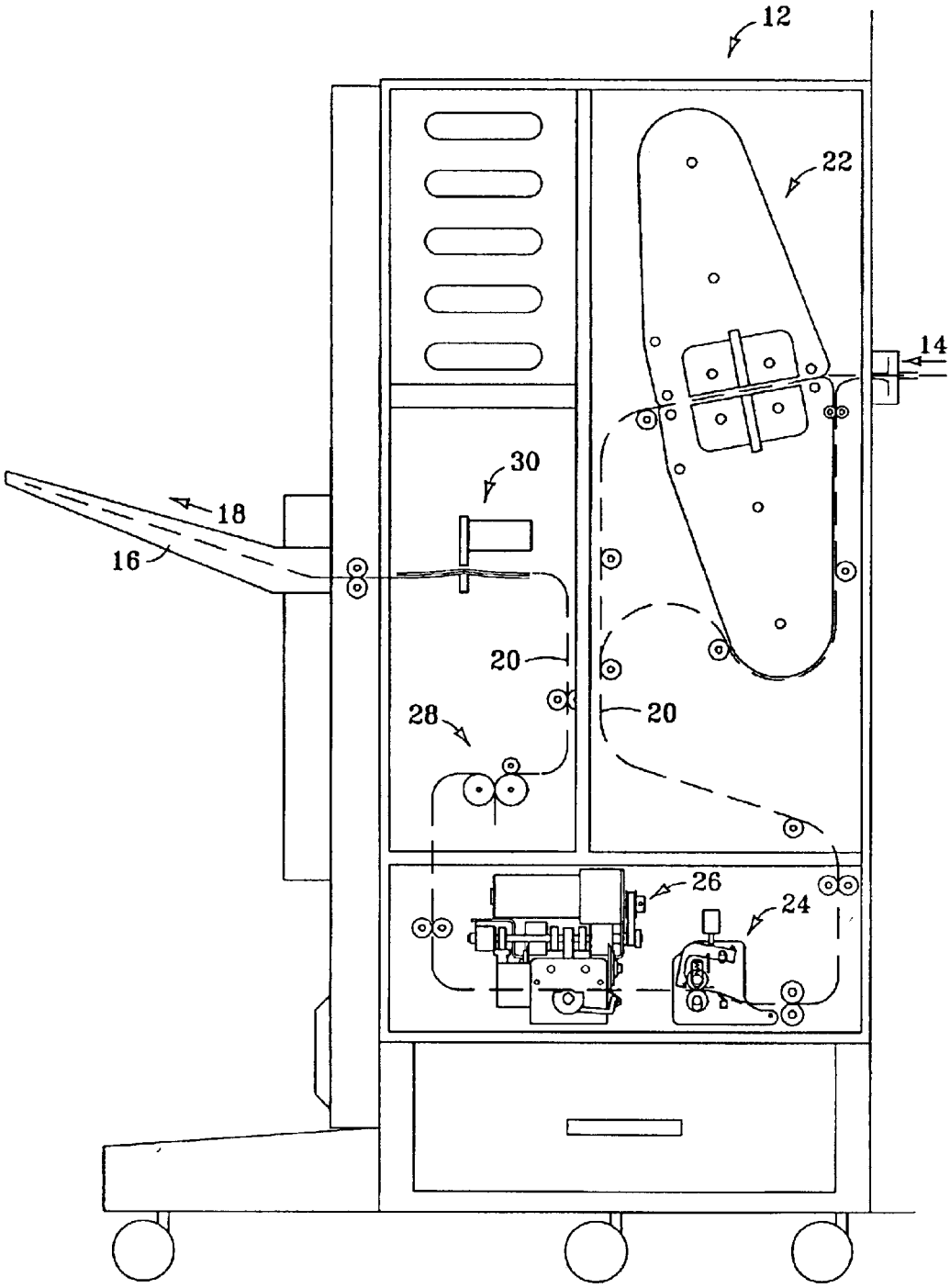
FIG. 2 is an elevation side view illustrating the major components and media path through a post print finishing device such as the one shown in FIG. 1.

FIG. 2 illustrates the major components and media path through a post print finishing device such as the one shown in FIG. 1. FIGS. 1–2 illustrate one exemplary environment in which embodiments of the invention may be implemented. The finishing device of FIG. 2 includes sheet coating, trimming and stapling, and booklet making capabilities. While it is believed that embodiments of the clamp of the present invention will be particularly useful for booklets and other multi-page documents, such as might be output by finishing device 12, embodiments of the invention may be used with any printer or print media output device in which it may be desirable to clamp documents in the output tray or bin.

Printer is used broadly in this document to mean any printing device including, for example, laser printers, inkjet printers, copiers and multi-function devices.

Referring to FIG. 2, printed media sheets are output to finishing device 12 as noted by arrow 14, and discharged from finishing device 12 to output tray 16 as noted by arrow 18. The media path through finishing device 12 is indicated by broken line 20 in FIG. 2. Media sheets output to finishing device 12 are transported through or around coating unit 22 to a pre-trim registration unit 24, trimming unit 26, folding unit 28 and stapling unit 30 before they are discharged to output tray 16.

Coating unit 22 coats printed media with a film of clear flexible material. Such coatings can be formulated and applied to help protect the printed image, enhance the printed image or provide a more uniform gloss level across the entire media (including both printed and unprinted areas). If a coating is not desired, then media sheets are moved along a bypass path around coating unit 22. Pre-trim registration unit 24 registers each sheet to trimming unit 26 before it enters trimmer 26. That is to say, registration unit 24 straightens or "deskews" each sheet as necessary to ensure the sheet is properly aligned in the media path as it enters trimmer 26. Trimming unit 26 trims the leading edge of each sheet or the trailing edge of each sheet, or both, as necessary to make the sheet the desired size for the finished booklet or other document. Folding unit 28 folds each sheet by creasing the sheet along the desired fold line. Stapling unit 30 staples each booklet after the sheets are trimmed, folded and assembled.

Figure 3:
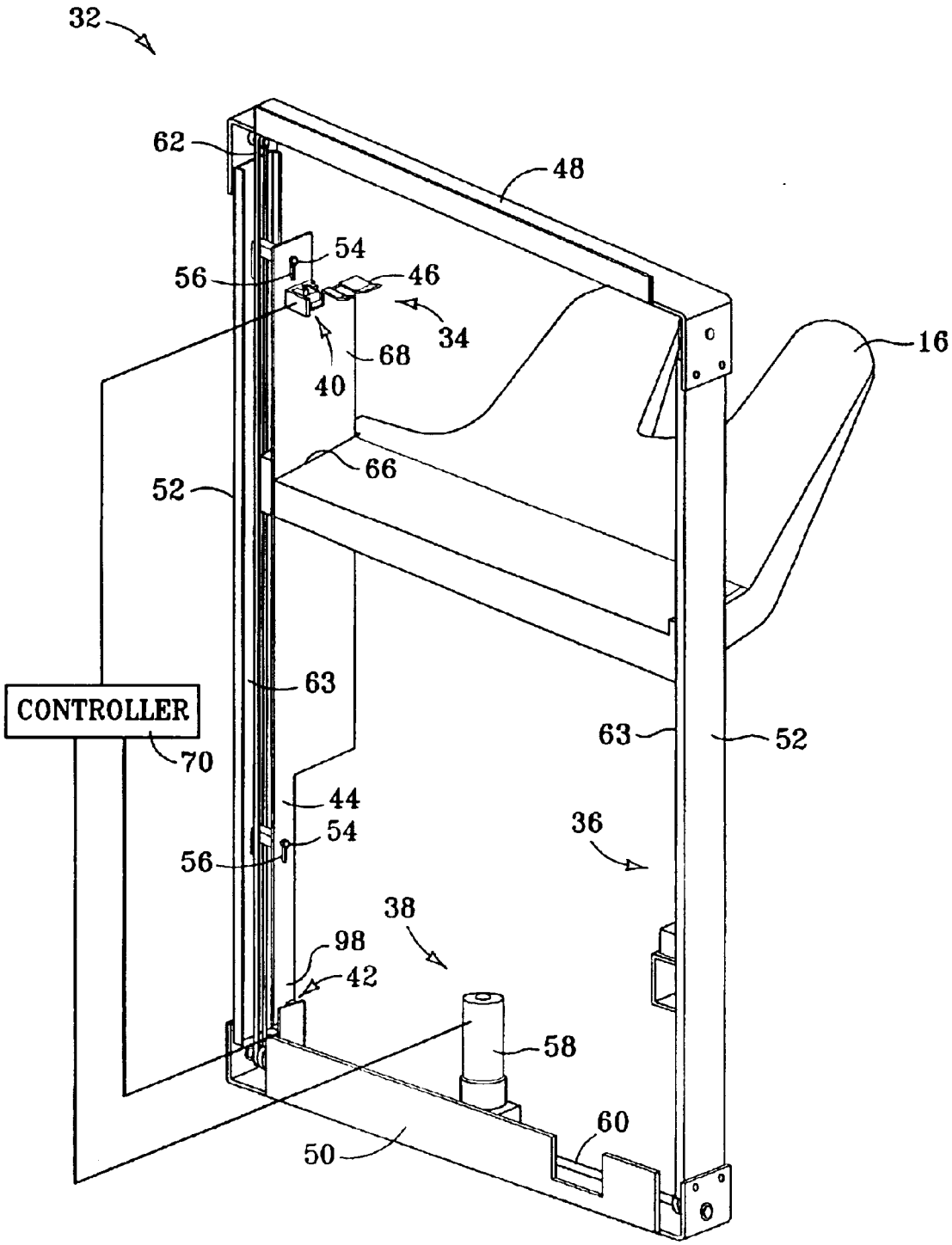
FIG. 3 is a perspective rear side view of an output device that incorporates a stack clamp according to one embodiment of the invention.
Figure 4:
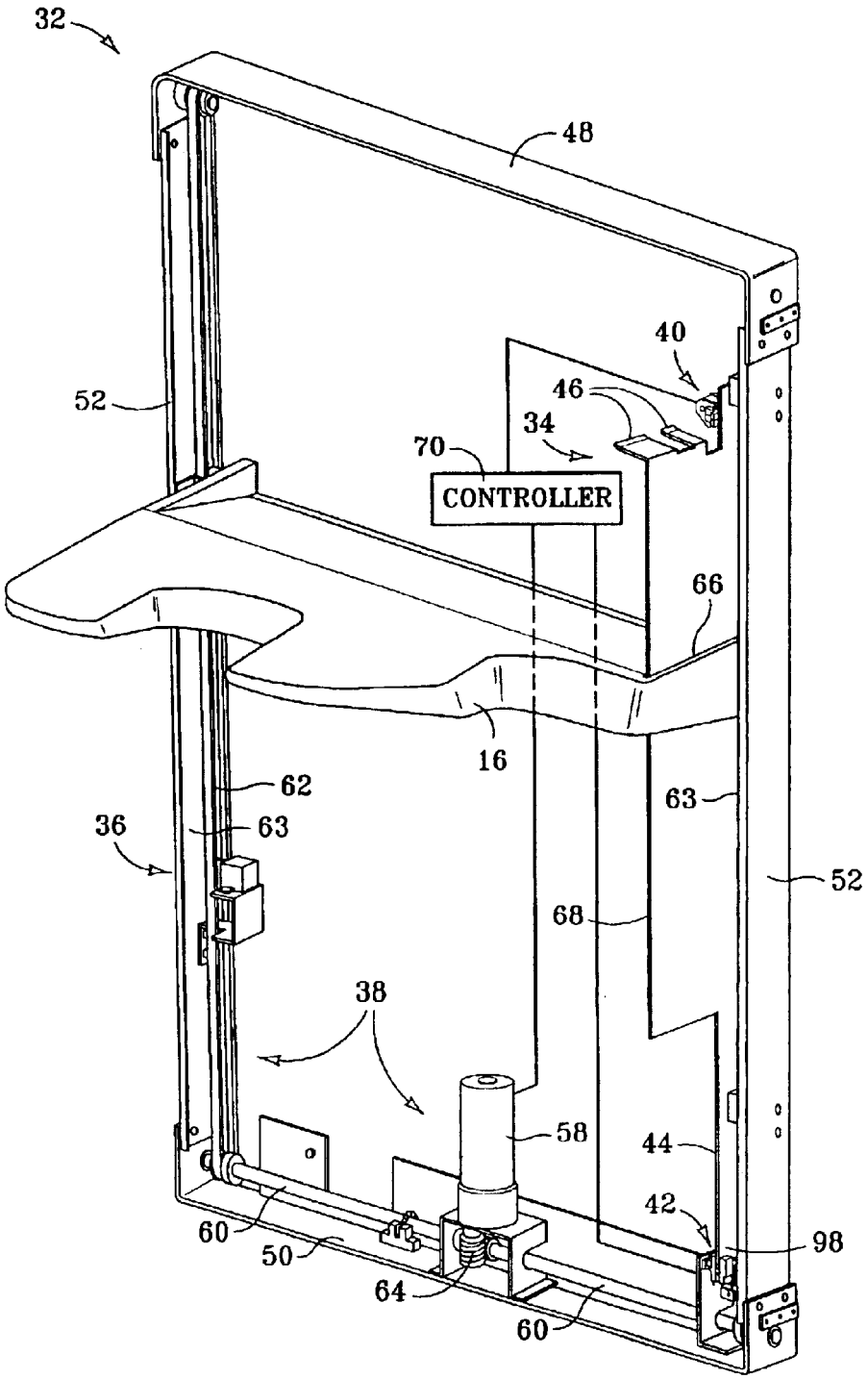
FIG. 4 is a perspective front side view of the output device of FIG. 3.

FIGS. 3 and 4 are perspective rear and front views, respectively, of an output device 32 that incorporates a clamp 34 constructed according to one embodiment of the invention. Referring to FIGS. 3 and 4, output device 32 includes output tray 16, clamp 34, frame 36, and a tray drive system 38. Clamp 34 includes an upper sensing module 40, a lower sensing module 42, a side plate 44 that extends between the sensing modules 40, 42 and pressure fingers 46 that extend out from the top of side plate 44.

Frame top member 48 and frame bottom member 50 extend between frame side members 52. Side plate 44 is mounted along one side member 52 on shoulder bolts 54 or other suitable fasteners that project out from frame side member 52. Shoulder bolts 54 ride in slots 56 in side plates 44 so that side plates 44 can slide up and down relative to frame 36 and tray 16.

Tray drive system 38 includes a reversing motor 58, drive shafts 60 and endless loop belts 62. Tray 16 is mounted between and moves along a pair of rails 63 attached to or integral with frame side members 52 at the urging of motor 58. Belts 62 are operatively connected to reversing motor 58 through shafts 60 and gears 64. Motor 58 is mounted to frame bottom member 50. Each side of tray 16 is connected to one run of each belt 62 so that belts 62 carry tray 16 along rails 63 as motor 58 drives belts 62 up and down together. The outboard ends of drive shafts 60 are supported on bearings or bushings (not shown) in frame bottom member 50. One side of output tray 16 is formed with a slot 66 or otherwise configured to fit around side plate 44 so that side plate 44 and tray 16 can move up and down relative to one another. Preferably, side plate 44 is enlarged through an area 68 covering the full range of motion of tray 16. Frame 36 and tray drive system 38 are described in more detail in commonly assigned U.S. patent application Ser. No. 10/396,276 filed Mar. 24, 2003 and entitled "Print Media Output Receptacle Rail Support And Drive System", incorporated herein by reference in its entirety.

A programmable controller 70 electrically coupled to motor 58 controls the position of tray 16. Although it is expected that controller 70 will be implemented as part of the controller for finishing device 12 shown in FIGS. 1 and 2, controller 70 could also be implemented as a discrete output device controller or as part of the printer controller for systems in which the printer controller controls print and post print operations or in systems in which the printer outputs directly to tray 16. As with conventional printer and finishing device controllers, controller 70 will typically include a processor and associated memory. Random access memory (RAM) or other suitable operational memory contains job data from the attached printer or host computer along with programming and other data currently being executed or used by the processor. Read only memory (ROM) or other suitable operational/storage memory contains the device firmware that provides programming instructions to control the operation of finishing device 12 and output device 32. Controller 70 executes firmware programming instructions according to command inputs from the attached printer or host computer and in response to input from sensors and other components of finishing device 12 and output device 32. Some embodiments of the invention, therefore, may be implemented through a computer readable medium with instructions that, when executed by controller 70 and/or another computer, control the operation of printer 10, finishing device 12 and/or output device 32. As used in this document, computer readable medium means any medium that can contain, store or propagate computer readable instructions.

Figure 14:
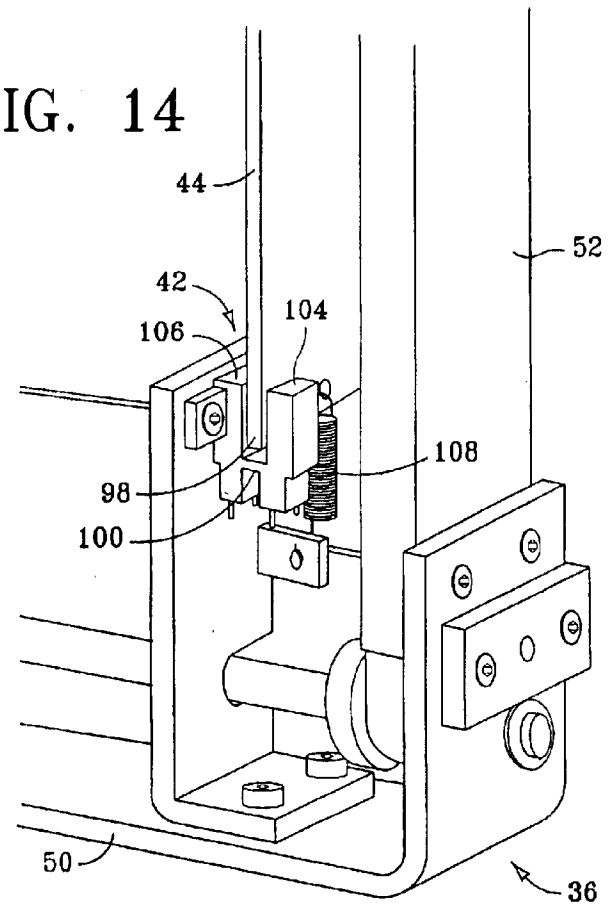

FIGS. 5–11 illustrate the structure and sequence of operation of clamp 34. FIG. 12 is a detail view of stack position sensor 40 with document stack 41 in the position shown in FIG. 8. FIGS. 13 and 14 are detail views of side plate position sensor 42 with the side plate in the positions shown in FIGS. 8 and 9, respectively. Referring to FIGS. 5–13, pressure fingers 46 are positioned at the upper reach of side plate enlarged area 68 and extend out over tray 16. Side plate 44 and a back stop 72 intersect to form a corner 74. Back stop 72 may be constructed as an integral part of tray 16 or as a discrete structural component positioned at the rear of tray 16. Each sheet, booklet or other document 71 is output to tray 16 through printer or finishing device output port 76 generally towards the center of tray 16 and, when necessary or desirable, moved against side plate 44 to align one edge of the documents, or into corner 74 to align two edges of the documents. Aligning the edges of the document is commonly refer to as registration, or registering the document. The technique for two edge alignment is commonly referred to as corner registration because each document is moved toward the corner of the tray. Registration devices are well known In the printing and paper handling arts. Any suitable registration device may be used to move the documents toward side plate 44 or into corner 74. For example, the registration device shown and described in commonly assigned U.S. patent application Ser. No. 10/396,276 filed Mar. 24, 2000 and entitled "Print Media Output Receptacle Rail Support And Drive System" may be adapted for use with stack clamp 34.

Pressure fingers 46 are positioned to reach out over the back corner of documents stacked into corner 74. As described in more detail below, pressure fingers 46 are used to hold or "clamp" documents in place while the next document is output to the stack. While two fingers 46 are shown, any number of fingers may be used. What is important is that fingers 46 create enough friction with the top document in the stack to hold that document in place while the next document is output to the stack.

As best seen in FIGS. 12 and 13, stack position sensor 40 is mounted to side plate 44 near pressure fingers 46. In the embodiment shown, stack position sensor 40 is mounted immediately behind fingers 46 at corner 74. Stack position sensor 40 may be mounted at any location where it will accurately detect the top of stack 41 under pressure fingers 46. In the embodiment shown, sensor 40 includes a pair of fixed optical sensors 78, 80 and a rotating gate 82 mounted to a U-shaped housing 84. Gate 82 is a pie-shaped plate that rotates on a pin 86 extending out from housing 84. Gate 82 passes through a detection zone 88 between an optical transmitter 90 and an optical receiver 92 mounted opposite one another across detection zone 88 for each sensor 78, 80. Each receiver 92 is electronically connected to controller 70 (controller 70 is shown in FIGS. 3 and 4). Although two optical sensors and a gate are shown, any magnetic, electronic or electro-mechanical device or combination of devices suitable for detecting the position of the top of stack 41 relative to pressure fingers 46 may be used.

Optical transmitters 90 may use a light emitting diode (LED), tungsten lamp, neon lamp or any other suitable source of light, preferably infrared light. Optical receivers 92 may use a phototransistor, photodiode, photoresistor or any other suitable light sensor. An opening 94 is formed through a portion of gate 82. Opening 94 is positioned in gate 82 such that light emitted by transmitters 90 will pass through gate 82 when gate 82 is toward the lower reach of its rotation through detection zone 88, as described in more detail below. The output signal from each receiver 92, which is transmitted to controller 70, indicates the presence or absence of gate 82 in detection zone 88. Gravity, a torsional spring (not shown) operatively coupled between pin 86 and gate 82 or another suitable biasing mechanism biases gate 82 to the fully clockwise and lowered position shown in FIG. 5. A stop bar 96 prevents gate 82 from rotating beyond the desired lowered position.

Figure 15:
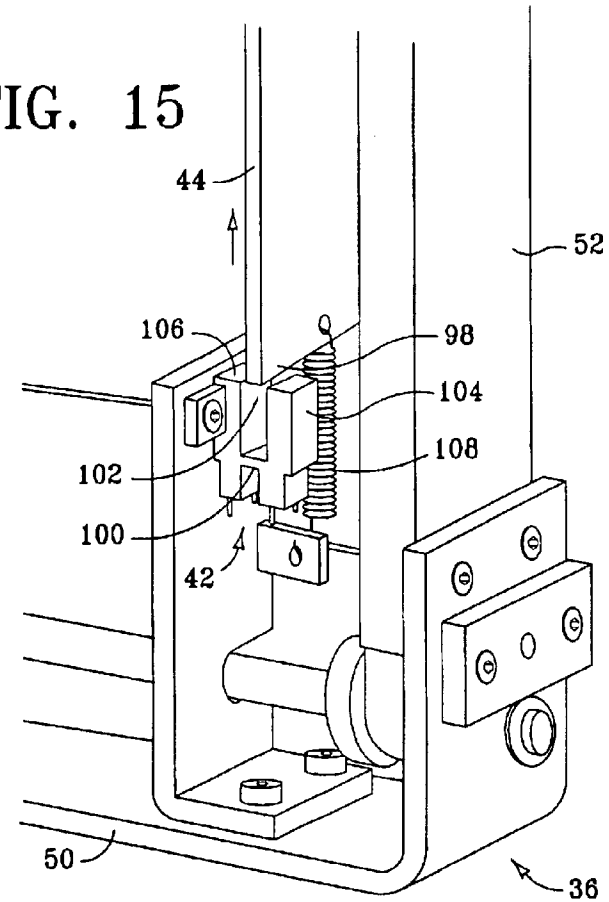
FIGS. 14 and 15 are detail views of the side plate position sensor of the stack clamp of FIGS. 5–11 in the positions shown in FIGS. 8 and 9, respectively.

As shown in FIGS. 14 and 15, side plate position sensor 42 is mounted to frame bottom 50 at the bottom end 98 of slide plate 44. In the embodiment shown, sensor 42 includes a fixed optical sensor 100. The bottom end of side plate 44 acts as a gate that moves into and out of a detection zone 102 between an optical transmitter 104 and an optical receiver 106 mounted opposite one another across detection zone 102 for sensor 42. Although an optical sensor is shown, any magnetic, electronic or electromechanical device or combination of devices suitable for detecting the position of side plate 44 may be used. Side plate position sensor 42 may be mounted at any location where it will accurately signal when side plate 42 has reached the desired raised position, as discussed in more detail below. For example, a magnetic sensor that reads a strip encoded with position information affixed to side plate 44 could be located anywhere along side plate 44.

Optical transmitter 104 may use a light emitting diode (LED), tungsten lamp, neon lamp or any other suitable source of light, preferably infrared light. Optical receiver 106 may use a phototransistor, photodiode, photoresistor or any other suitable light sensor. Sensor 42 is positioned relative to side plate bottom end 98 such that light emitted by transmitter 104 is blocked when side plate 44 is at the lower reach of its travel that, preferably, is defined by the bottom of slots 56. The output signal from receiver 106, transmitted to controller 70, indicates the presence or absence of side plate bottom end 98 in detection zone 102.

A spring 108 operatively coupled between side plate 44 and frame 36 or another suitable biasing mechanism pulls down on side plate 44.

Figure 5:
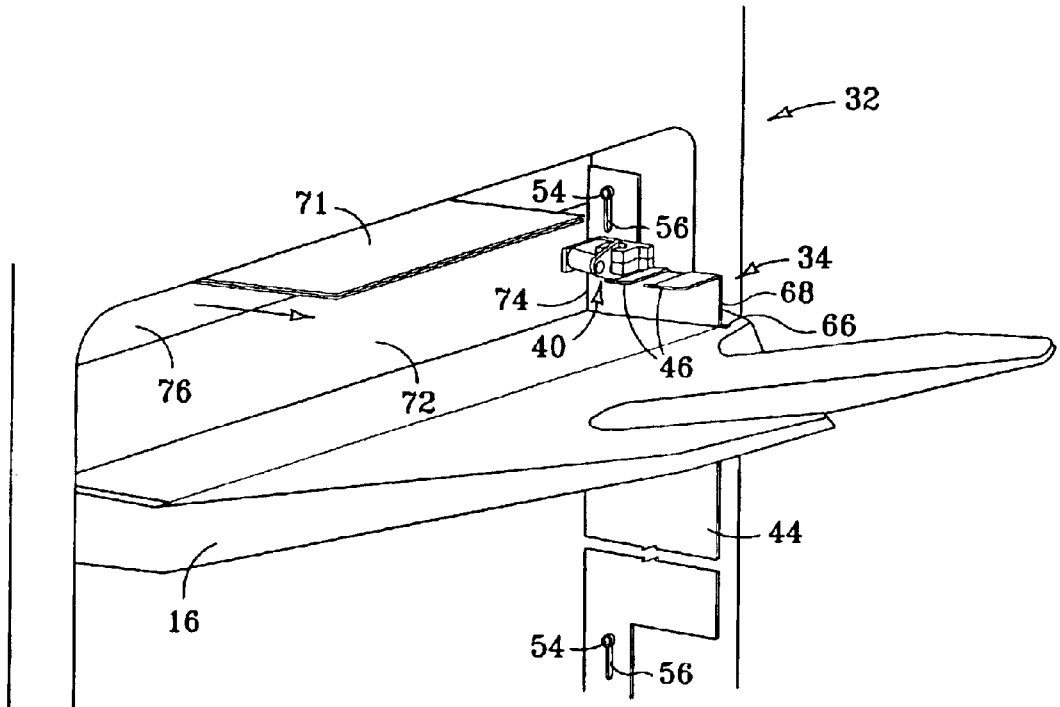

Referring now in sequence to FIGS. 5–11, clamp 34 rests with side plate 44 fully lowered and output tray 16 positioned below pressure fingers 46 a distance sufficient to allow the first document 71 to slide easily into corner 74, as shown in FIG. 5. In this position, stack position sensor gate 82 is rotated down, opening 94 is positioned in sensor detection zone 88 for both sensors 78 and 80 (FIGS. 12 and 13) and, therefore neither sensor 78, 80 is blocked.

Figure 6:
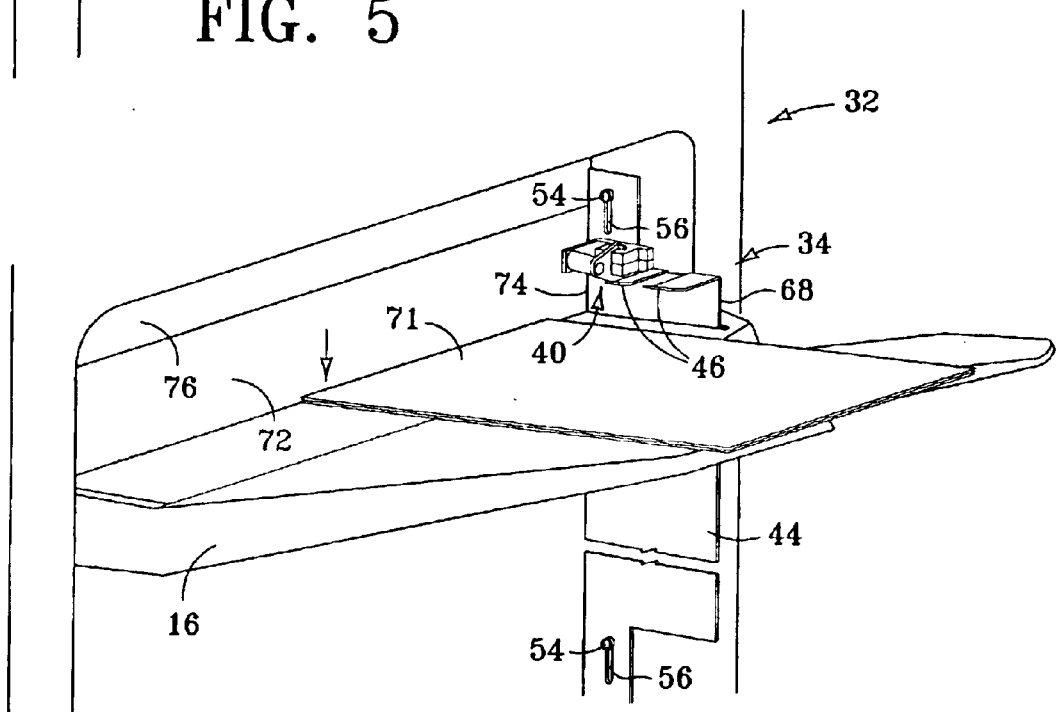
Figure 7:
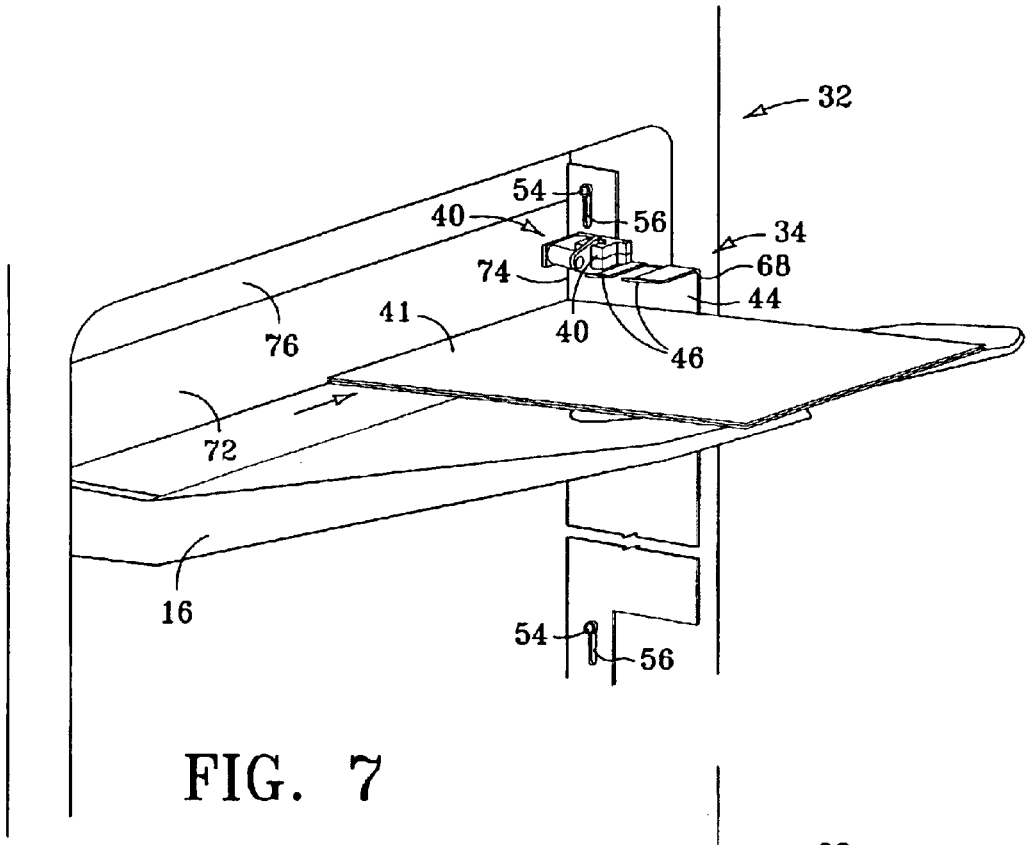
Figure 8:
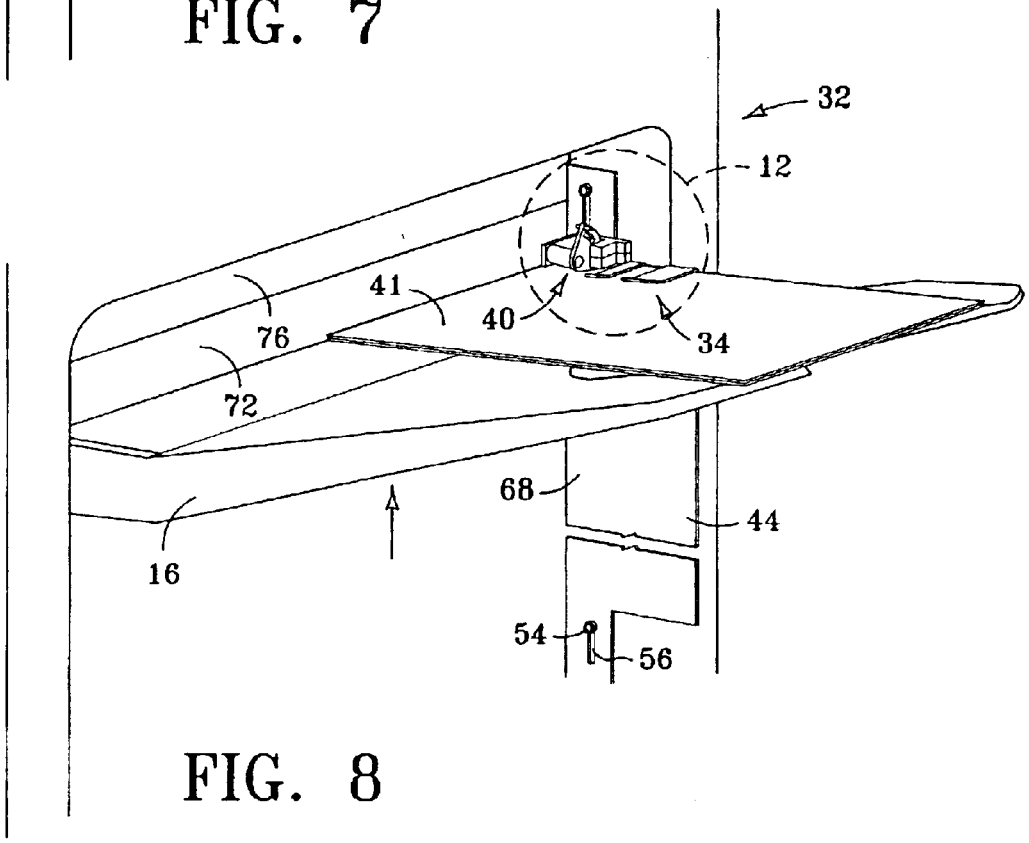
Figure 9:
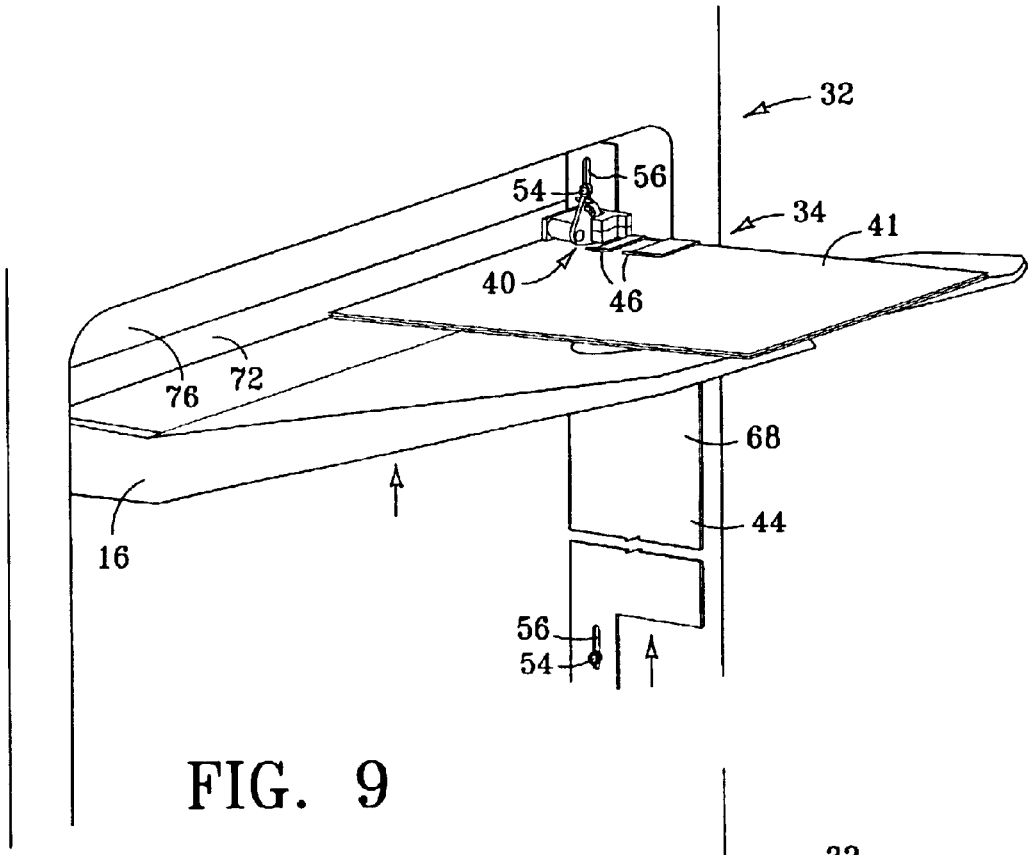

In operation, document 71 is output through port 76 on to tray 16 as shown in FIGS. 5 and 6. In FIG. 7, document 71 is registered to corner 74, and re-designated as stack 41 now that it is in the stack position. Controller 70 then energizes reversing motor 58 (FIGS. 3 and 4) to move tray 16 up to press the top of stack 41 against pressure fingers 46 and raise side plate 44 until the bottom end 98 of side plate 44 clears detection zone 102, as best seen by comparing FIGS. 8–9 and 14–15. When side plate bottom end 98 clears detection zone 102, side plate position sensor 42 signals controller 70 that side plate 44 and pressure fingers 46 have reached the raised/clamping position shown in FIG. 9. Controller 70 then shuts down motor 58. In this position, spring 108 is extended to pull down on side plate 44 and exert a clamping force on stack 41 through pressure fingers 46. In this position, and referring also to the components shown in FIGS. 12 and 13, stack position sensor gate 82 is pushed up into detection zone 88 for both sensors 78 and 80 and, therefore both sensors 78, 80 are blocked.

Figure 10:
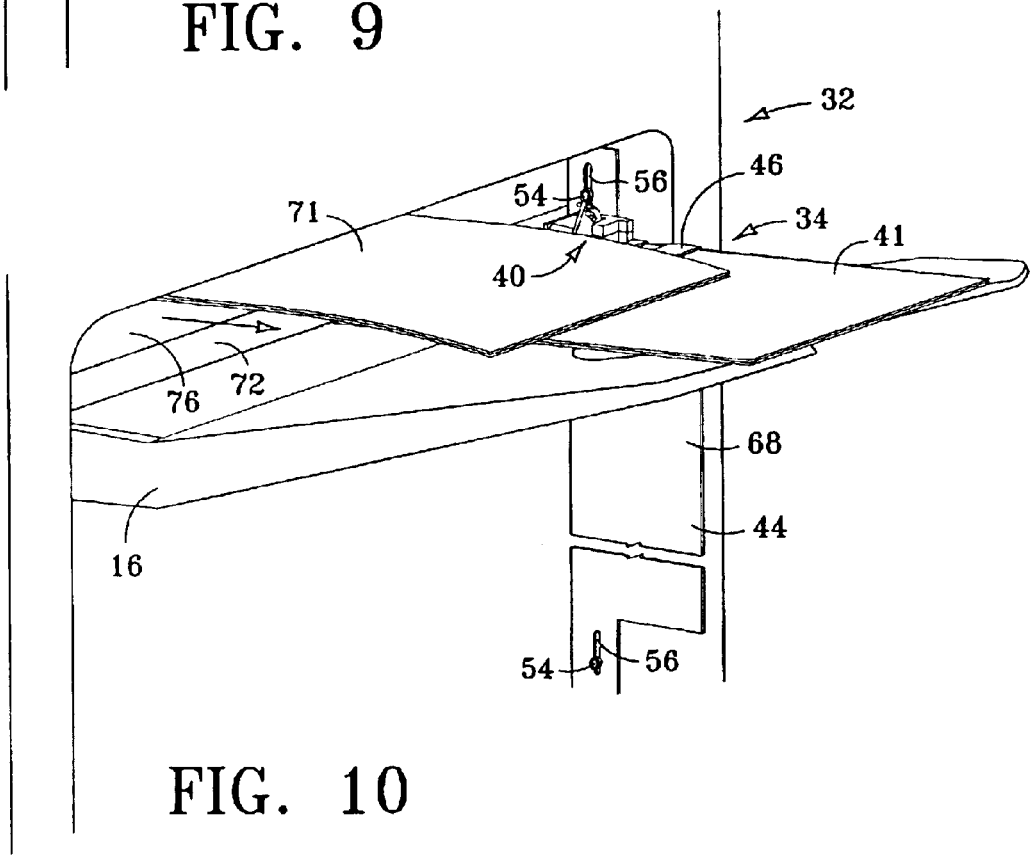

In FIG. 10, a second document 71 is output to stack 41 while stack 41 is clamped. Then, as shown in FIG. 11, controller 70 energizes reversing motor 58 to lower tray 16 until stack 41 drops below pressure fingers 46, gate 82 clears detection zone 88 and stack position sensor 40 signals controller 70 that neither sensor 78, 80 is blocked. Controller 70 then reverses motor 58 to raise output tray 16 until gate 82 (FIG. 12) enters detection zone 88 again and stack position sensor 40 signals controller 70 that lower sensor 80 is blocked. Controller 70 then shuts down motor 58. In this way, tray 16 is accurately positioned at the desired distance below pressure fingers 46 so that second document 71 can be registered into corner 74 and the clamping sequence is repeated until all documents have been output to the stack. When upper sensor 78 is open and lower sensor 80 is blocked, then tray 16 is in the correct position to allow registration of the next document. If both sensors 78 and 80 are open, then tray 16 is too low for next document registration. If both sensors 78 and 80 are blocked, then tray 16 is too high for next document registration.

The exemplary embodiments shown in the figures and described above illustrate but do not limit the invention. Other forms, details, and embodiments may be made and implemented. Hence, the foregoing description should not be construed to limit the spirit and scope of the invention, which is defined in the following claims.

What is claimed is:

1. A print media output device, comprising:

an output receptacle;

a generally L shaped structure having a first part extending over and facing the receptacle and a second part extending along one side of the receptacle;

one or both of the receptacle and the structure movable relative to one another such that print media output to the receptacle can be alternately clamped between the first part of the structure and the receptacle and released; and the structure movable from a first released position to a second clamping position in which the structure is continually urged toward the first position.

2. The device of claim 1, wherein the receptacle comprises a tray.

3. The device of claim 1, further comprising a biasing mechanism operatively connected to the second part of the structure, the biasing mechanism operative to urge the structure from the second position toward the first position.

4. The device of claim 3, wherein the biasing mechanism is a spring.

5. A print media output device, comprising:

a motor;

an output receptacle operatively coupled to the motor, the receptacle movable between a receptacle first position and a receptacle second position;

a plate extending along one side of the receptacle;

a finger fixed to the plate and extending over the receptacle, the finger movable with the plate and the receptacle from a finger first position that corresponds to the receptacle first position and a finger second position that corresponds to the receptacle second position; and a biasing mechanism operatively connected to the plate and the finger such that when the finger is in the finger second position the biasing mechanism urges the finger back toward the finger first position.

6. The device of claim 5, wherein the receptacle movable between a receptacle first position and a receptacle second position comprises the receptacle movable up and down between a receptacle lowered position and a receptacle raised position.

7. The device of claim 6, wherein the finger movable with the receptacle from a finger first position that corresponds to the receptacle first position and a finger second position that corresponds to the receptacle second position comprises the finger movable up and down between a finger lowered position that corresponds to the receptacle lowered position and a finger raised position that corresponds to the receptacle raised position.

8. A print media output device, comprising:

a reversing motor;

a horizontally oriented output receptacle operatively coupled to the motor, the receptacle movable up and down at the urging of the motor;

a vertically oriented plate extending along one side of the receptacle, the plate movable up and down with the receptacle between a lowered position and a raised position;

a finger fixed to the plate and extending over the receptacle; and a biasing mechanism operatively connected to the plate such that when the plate is in the raised position the biasing mechanism urges the plate back toward the lowered position.

9. The device of claim 8, wherein the finger is integral to the plate.

10. The device of claim 8, wherein the biasing mechanism is a spring.

11. The device of claim 8, wherein the plate extends through a slot in the receptacle and the receptacle is moveable up and down along the plate.

12. A print media output device, comprising:

a frame;

a pair of vertically oriented rails disposed opposite one another and supported by the frame;

a reversing motor supported by the frame;

a horizontally oriented output receptacle operatively coupled to the motor, the receptacle extending between and mounted to the rails for movement thereon up and down at the urging of the motor;

a vertically oriented plate supported by the frame, the plate extending along one side of the receptacle and the plate moveable with the receptacle between a first lowered position and a second raised position;

a finger fixed to the plate and extending over the receptacle;

a biasing mechanism operatively connected to the plate such that when the plate is in the raised position the biasing mechanism urges the plate toward the lowered position;

a first position sensor operatively coupled to the plate, the first position sensor configured to detect when the plate reaches the raised position; and a controller electronically connected to the motor and the first position sensor, the controller configured to drive the reversing motor in one direction to move the receptacle up until the first position sensor detects that the plate has reached the raised position.

13. The device of claim 12, further comprising a second sensor mounted to the plate adjacent to the finger, the second sensor configured to detect when the top of a document or stack of documents in the receptacle has reached a predetermined position below the finger and wherein the controller is electronically connected to the second sensor and the controller is further configured to drive the reversing motor in one or both directions until the second position sensor detects that the top of the document or stack of documents has reached the predetermined position below the finger.

* * * * *